US007364515B2

(12) United States Patent
Kasashima

(10) Patent No.: US 7,364,515 B2
(45) Date of Patent: Apr. 29, 2008

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 512 days.

(21) Appl. No.: 10/623,771

(22) Filed: Jul. 22, 2003

(65) Prior Publication Data

US 2004/0121858 A1 Jun. 24, 2004

(30) Foreign Application Priority Data

Jul. 26, 2002 (JP) ..... 2002-217637
Sep. 6, 2002 (JP) ..... 2002-261233

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | |
|---|---|---|---|---|
| 1,681,167 | A * | 8/1928 | Beldam | 473/383 |
| 2,135,210 | A * | 11/1938 | Farrar | 473/383 |
| 4,006,908 | A * | 2/1977 | Minami | 473/200 |
| 5,547,197 | A | 8/1996 | Pocklington | |
| 5,879,245 | A | 3/1999 | Hwang | |
| 6,217,462 | B1 * | 4/2001 | Maruko et al. | 473/370 |
| 6,217,463 | B1 * | 4/2001 | Maruko et al. | 473/370 |
| 6,290,615 | B1 * | 9/2001 | Ogg | 473/378 |
| 2002/0032083 | A1 * | 3/2002 | Ogg | 473/378 |
| 2004/0087389 | A1 * | 5/2004 | Kasashima et al. | 473/383 |
| 2004/0127306 | A1 * | 7/2004 | Sato et al. | 473/383 |

FOREIGN PATENT DOCUMENTS

| | | | |
|---|---|---|---|
| JP | 64-025874 | A | 1/1989 |
| JP | 8-276035 | A | 10/1996 |
| JP | 10-108921 | A | 4/1998 |
| JP | 2001-212260 | A | 8/2001 |
| WO | WO 01/36053 | A1 | 5/2001 |

* cited by examiner

*Primary Examiner*—Raeann Trimiew
(74) *Attorney, Agent, or Firm*—Sughrue Mion, PLLC

(57) ABSTRACT

A golf ball has a plurality of linearly or curvilinearly extending ridge-like lands on its spherical surface. The percent occupation of the total of land areas relative to the overall area of a phantom spherical surface assumed at the level of the top of lands can be reduced to substantially zero.

17 Claims, 3 Drawing Sheets

GOLF BALL

BACKGROUND OF THE INVENTION

1. Technical Field

This invention relates to a golf ball having improved flight performance.

2. Background Art

As is well known in the art, in order that a golf ball which was launched gets a long travel distance, the high rebound of the ball itself and the reduced air resistance during flight due to dimples arranged on the ball surface are crucial factors. A number of methods have been proposed for arranging dimples on the entire ball surface at as high a density and as uniformly as possible to reduce the air resistance.

Most often the dimples are recesses or dips of a circular shape as viewed in plane. Even when the width of a land partitioning two adjacent dimples is reduced to nearly zero in order to arrange circular dimples at a higher density, the zone surrounded by three or four dimples becomes a land of generally triangular or tetragonal shape having a certain area. Since it is requisite that circular dimples be arranged on the spherical surface as uniformly as possible, the design effort must reach a certain compromise on the distribution density of circular dimples.

Under the circumstances, it would be desirable to arrange dimples at a higher density and uniformly. To this end, JP-A 2001-212260 proposes that dimples of about two to five types having different diameters are arranged on the spherical surface of a ball which is assumed to be a regular octahedron or regular icosahedron.

However, as long as circular dimples are used, the percent occupation of the total of dimple areas on the overall spherical surface area has a practical limit of about 75% (the total of land areas accounting for about 25% of the overall spherical surface area). It is then desired that in order to arrange dimples on the ball surface so as to further reduce the air resistance of the ball in flight, the percent occupation of the total of dimple areas on the overall spherical surface area be further improved.

SUMMARY OF THE INVENTION

An object of the invention is to provide a golf ball whose flight performance is improved by increasing the percent occupation of the total of dimple areas on the overall spherical surface area.

Focusing on the shape of lands, the inventor has found that the designing of lands to a specific shape enables to substantially reduce the proportion of lands on the spherical surface and to arrange the lands uniformly.

Accordingly, the invention provides a golf ball comprising a plurality of linearly or curvilinearly extending ridge-like lands on its spherical surface.

Preferably, the ridge-like lands are combined to define a multiplicity of cavities. The cavities preferably have a polygonal shape in plane. More preferably, one polygonal cavity has corners at least one of which is formed with a gap through which the one cavity is in communication with another polygonal cavity that is disposed adjacent to the one cavity via a land. Typically, the lands include at least one shape element selected from I, T, L, H and crisscross shapes. Preferably, the lands have a height of 0.05 to 0.4 mm and a width at their base of 0.8 to 2.0 mm. Often the total number of lands is 300 to 600.

DETAILED DESCRIPTION OF THE INVENTION

Figure 1:
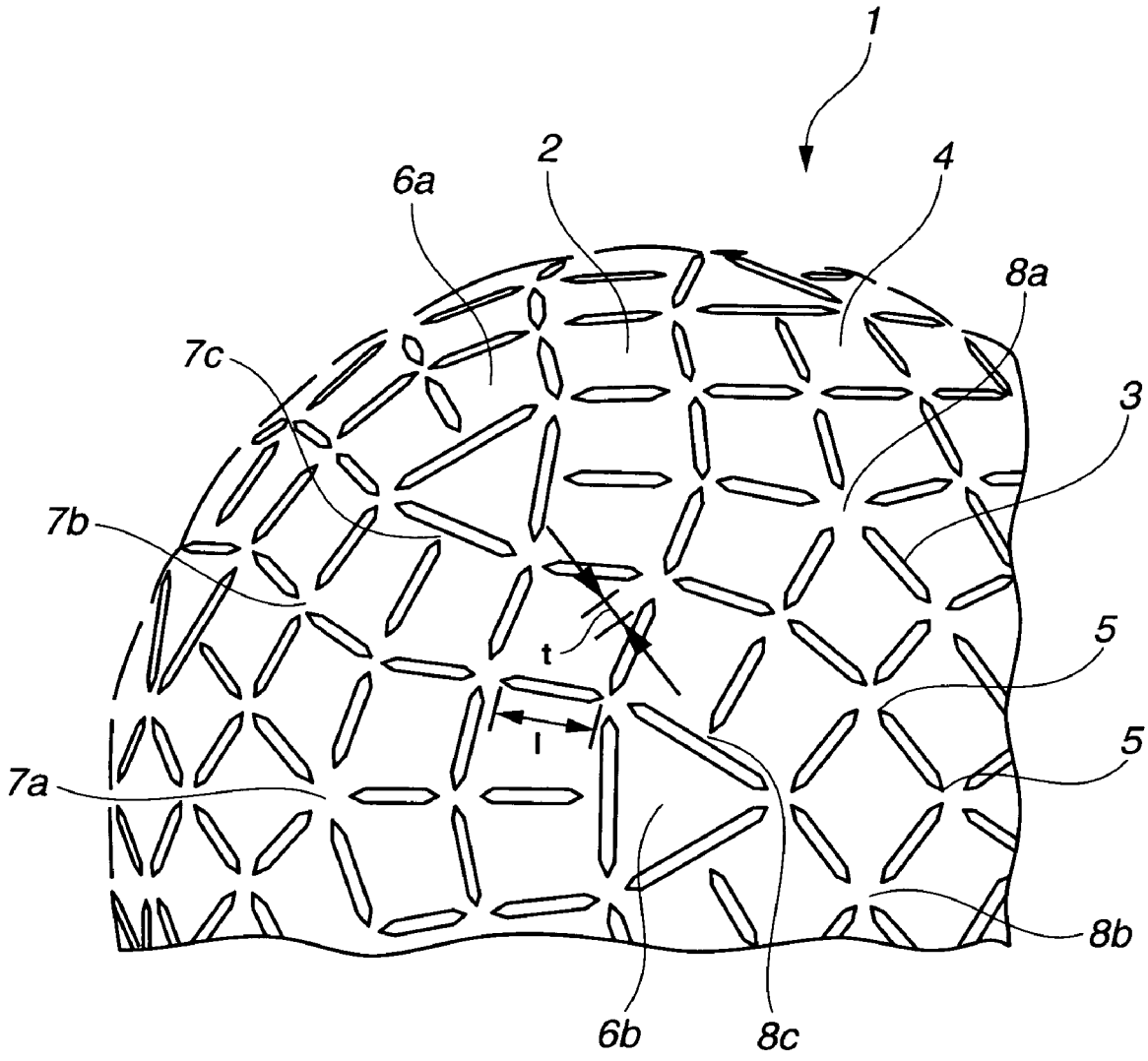
FIG. 1 is a partial plan view of a golf ball according to one embodiment of the invention.
Figure 3:
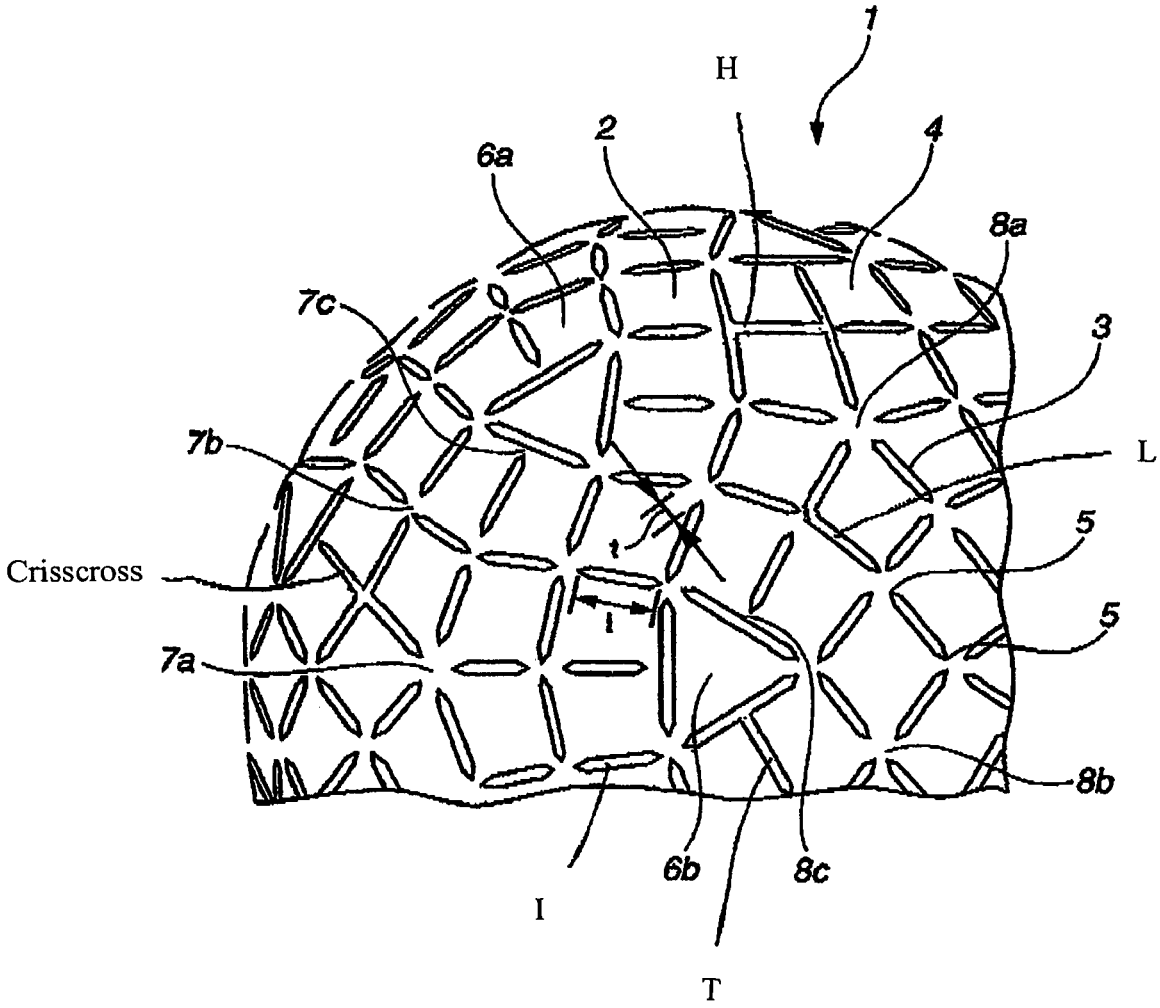
FIG. 3 is a partial plan view of a golf ball according to a non-limiting embodiment of the invention and illustrates lands that have I, L, T, H and crisscross (+) shapes.

Referring to FIG. 1, there is illustrated in plan view a portion of a golf ball 1 according to one embodiment of the invention. The golf ball in the form of a spherical elastic body has a spherical surface 2 on which a plurality of discrete, linearly extending ridge-like lands 3 are arranged. The ridge-like lands 3 are combined to define a multiplicity of cavities or recesses 4. One cavity 4 is surrounded by several lands 3. In this embodiment, the cavities 4 are arranged substantially uniformly over the spherical surface. The lands 3 have a linear shape or I-shape in FIG. 1, but the shape of lands (as viewed in plane) is not limited thereto. The lands may also be constructed by one or more shape elements including curvilinearly extending shapes such as an arcuate shape and S-shape and variant linear shapes such as T, L, H and crisscross (+) shapes (as illustrated in FIG. 3). Alternatively, such a different shape element may be partially incorporated in a land of linear shape or vice versa. It is noted that the term "linearly" or "curvilinearly" extending land means that a land extends linearly or curvilinearly as viewed in plane at that land position and as seen in FIG. 1 and FIG. 3.

In the golf ball of the invention, each of the lands may have at least one end 5 in a longitudinal direction thereof as shown in the embodiment of FIG. 1. In the case of an I or L-shaped land, for example, the land has ends on both sides in a longitudinal direction thereof (i.e., two ends). A T-shaped land has three ends. An H or crisscross-shaped land has four ends.

In FIG. 1, I-shaped lands 3 are dispersedly distributed substantially uniformly over the spherical surface. As a result, four I-shaped lands define a tetragonal cavity 6*a*, and three I-shaped lands define a triangular cavity 6*b*. The shape of cavities is not limited to the tetragonal and triangular shapes, and various polygonal shapes may be defined through choice of the number and arrangement of lands. In this regard, the cavity can be constructed as a closed cavity by arranging lands in a closed loop fashion, and such closed cavities may be partially incorporated in some embodiments. In a preferred embodiment, however, when a cavity is defined by arranging several lands, at least some of the lands are spaced apart to leave a gap therebetween whereby adjacent cavities are in communication through the gap. In the preferred embodiment of FIG. 1, one cavity has corners (7*a*, 7*b* or 7*c*) each formed with a gap (8*a*, 8*b* or 8*c*) through which the one cavity is in communication with another cavity that is disposed adjacent to the one cavity via the land 3. Although a polygonal cavity is provided with gaps at all the corners in the embodiment of FIG. 1 because of the I-shaped lands used, the number of gaps per polygonal cavity varies with the shape of lands used.

The gap which provides communication between two cavities disposed adjacent to each other via a land has a distance t, preferably in the range of 0.5 to 2 mm.

The length of lands may be properly selected and vary with the shape of lands. For example, I-shaped lands usually have a length l of at least 1.0 mm, preferably at least 2.0 mm and up to 8.0 mm, preferably up to 6.0 mm. If the length l of lands is too large, the distribution balance of lands may be compromised. If the length l of lands is too small, the aerodynamic function of lands may be reduced. It is preferred to use lands of different lengths within the above range in combination such as short, medium and long lands.

FIG. 2 is a transverse cross-sectional view of a land on the golf ball surface, as seen in a section extending radially from the center of the ball (not shown).

The land usually has a height h of usually at least 0.05 mm, preferably at least 0.1 mm and up to 0.4 mm, preferably up to 0.3 mm. Too high a land height h may increase the air resistance whereas too low a land height h may reduce the arrangement effect. It is preferred that the lands have a unity height within the above range.

The land at its base 32 (joined to the surface 2 of the spherical body) usually has a width w of at least 0.8 mm and up to 2.0 mm. Too large a land base width w may impair the aerodynamic performance. With too small a land base width w, lands can be broken or damaged upon impact.

Figure 2A:
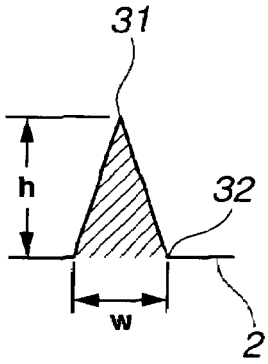
FIG. 2 is a transverse cross-sectional view of a land on the golf ball surface, FIG. 2*a* showing a land of triangular shape, FIG. 2*b* showing a land of convergent trapezoidal shape, FIG. 2*c* showing a land of round top triangular shape, and FIG. 2*d* showing a land of rectangular shape, in cross section.
Figure 2B:
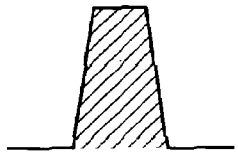
Figure 2C:
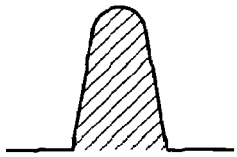
Figure 2D:
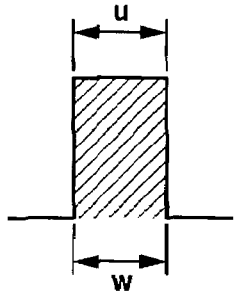

FIG. 2*a* shows a land of triangular shape in cross section having a top 31 and a base 32 wherein the width of top 31 is substantially zero. FIG. 2*b* shows a land of outward convergent trapezoidal shape in cross section. FIG. 2*c* shows a land of round top triangular shape in cross section. FIG. 2*d* shows a land of rectangular or square shape in cross section having a top with a width u and a base with a width w wherein u is substantially equal to w. It is preferred to shape lands such that the width w at the base is a few times greater than the width u at the top because such lands are more durable.

Each land may be formed to the same width or the same cross-sectional shape throughout its longitudinal direction. Alternatively, the land may be formed to varying width as being constricted or bulged as long as the objects of the invention are not impaired.

When it is desired to arrange the cavities 4 surrounded by the lands 3, shown in FIG. 1, evenly over the spherical surface, one possible approach is by dividing the spherical surface into surface regions of a polyhedron such as an octahedron, dodecahedron or icosahedron, properly arranging the cavities 6*a* and 6*b* defined by combinations of lands on each polygonal (or triangular) unit, and distributing them over the spherical surface. Also, the cavities 4 of different shapes may be randomly arranged over the spherical surface. In an alternative procedure, the lands 3 of different shapes are properly arranged over the spherical surface rather than arranging the cavities 4, and as a result of such arrangement, the cavities 4 are concomitantly formed.

According to the invention, the proportion of the total of land areas (at the top level of lands) relative to the overall spherical surface is reduced to substantially zero or small values approximate to zero, particularly when the lands of cross-sectional shape shown in FIGS. 2*a* and 2*c* are applied. With respect to the type of cavities, there may be used cavities of from one type to about five types, including cavities of different shapes and cavities of the same shape, but of different sizes (areas). The total number of lands (total number of shape elements including I, T, L, H and + shapes) is preferably from 300 to 600 for practical purposes.

According to the invention, when a phantom spherical surface is assumed at the level of the top of lands, the percent occupation of the total of land areas relative to the overall area of the phantom spherical surface can be reduced to substantially zero. Differently stated, the percent occupation of the total of cavity areas relative to the overall area of the phantom spherical surface can be increased to approximately 100% in a substantial sense. As a result, the flight performance of the golf ball can be dramatically improved.

Japanese Patent Application Nos. 2002-217637 and 2002-261233 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a plurality of linearly or curvilinearly extending ridge-like lands, which are separate from each other, on a spherical surface of the golf ball, wherein the ridge-like lands are grouped to define a multiplicity of cavities, and wherein the cavities have a polygonal shape in plane;

wherein the plurality of linearly or curvilinearly extending ridge-like lands are provided on a spherical outer surface of the golf ball.

2. A golf ball comprising a plurality of linearly or curvilinearly extending ridge-like lands on a spherical surface of the golf ball, wherein the ridge-like lands are combined to define a multiplicity of polygonal cavities, and wherein a polygonal cavity has corners at least one of which is formed with a gap through which the polygonal cavity is in communication with another polygonal cavity that is disposed adjacent to the polygonal cavity via a land;

wherein the plurality of linearly or curvilinearly extending ridge-like lands are provided on a spherical outer surface of the golf ball.

3. A golf ball comprising a plurality of linearly or curvilinearly extending ridge-like lands, which are separate from each other, on a spherical surface of the golf ball, wherein the lands have a length of at least 1.0 mm and up to 8.0 mm, wherein the lands have a round top portion.

4. The golf ball of claim 3, wherein the plurality of linearly or curvilinearly extending ridge-like lands are provided on a spherical outer surface of the golf ball.

5. A golf ball comprising a plurality of linearly or curvilinearly extending ridge-like lands on a spherical surface of the golf ball, wherein the lands have a length of at least 1.0 mm and up to 8.0 mm, and wherein each of the plurality of lands is not connected to any other land on the spherical surface of the golf ball;

wherein the plurality of linearly or curvilinearly extending ridge-like lands are provided on a spherical outer surface of the golf ball.

6. The golf ball of claim 5, wherein the ridge-like lands are grouped to define a multiplicity of cavities.

7. The golf ball of claim 5, wherein the lands have a top portion that approximates an apex of a triangle in a cross-sectional shape.

8. The golf ball of claim 5, wherein the lands have a top portion that approximates a top of a convergent trapezoid in a cross-sectional shape.

9. The golf ball of claim 5, wherein the lands have at least two ends in a longitudinal direction thereof.

10. The golf ball of claim 5, wherein the lands have different lengths in combination that are relatively short, medium and long.

11. The golf ball of claim 5, wherein the lands include at least one shape element selected from I, T, L, H and crisscross shapes.

12. A golf ball comprising a plurality of linearly or curvilinearly extending ridge-like lands, which are separate from each other on a spherical surface of the golf ball, wherein said lands have different lengths and shapes and are arranged over the spherical surface.

13. The golf ball of claim 12, wherein the lands include at least one shape element selected from I, T, L, H and crisscross shapes.

14. The golf ball of claim 12, wherein the plurality of linearly or curvilinearly extending ridge-like lands are provided on a spherical outer surface of the golf ball.

15. A golf ball comprising a plurality of linearly or curvilinearly extending ridge-like lands on a spherical surface of the golf ball, wherein each of the plurality of lands is not connected to any other land on the spherical surface of the golf ball, and wherein the lands have a height of 0.05 to 0.4 mm and a width at their base of 0.8 to 2.0 mm;

wherein the plurality of linearly or curvilinearly extending ridge-like lands are provided on a spherical outer surface of the golf ball.

16. A golf ball comprising a plurality of linearly or curvilinearly extending ridge-like lands on a spherical surface of the golf ball, wherein each of the plurality of lands is not connected to any other land on the spherical surface of the golf ball, and wherein the total number of lands is 300 to 600.

17. The golf ball of claim 16, wherein the plurality of linearly or curvilinearly extending ridge-like lands are provided on a spherical outer surface of the golf ball.

* * * * *